US006070668A

United States Patent [19]

Parks et al.

[11] Patent Number: 6,070,668

[45] **Date of Patent: *Jun. 6, 2000**

[54] BLOWOUT PREVENTER SPANNER JOINT WITH EMERGENCY DISCONNECT CAPABILITY

[75] Inventors: Williams C. Parks, Katy; Walter S. Going, III, Houston; Michael W. Spiering, Kingwood; Reginald L. Currier, Houston, all of Tex.

[73] Assignee: Sonsub Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/965,715

[22] Filed: Nov. 7, 1997

Related U.S. Application Data

[60] Provisional application No. 60/030,627, Nov. 8, 1996.

[51] Int. Cl.[7] ..... E21B 17/06; E21B 33/038

[52] U.S. Cl. ..... 166/345; 166/242.1; 166/242.3; 166/359; 166/363; 166/365; 285/124.1; 285/332

[58] Field of Search ..... 166/97.1, 242.1, 166/242.3, 242.6, 345, 359, 363, 365; 285/1, 322, 124.1

[56] References Cited

U.S. PATENT DOCUMENTS

| | | | |
|---|---|---|---|
| Re. 27,464 | 8/1972 | Taylor, Jr. | 166/363 |
| 3,288,493 | 11/1966 | Brown | 166/345 X |
| 3,461,958 | 8/1969 | Brown | 166/365 X |
| 3,741,294 | 6/1973 | Merill | 166/363 X |
| 4,116,272 | 9/1978 | Barrington | 166/363 X |
| 4,183,404 | 1/1980 | James et al. | 166/363 X |
| 4,611,662 | 9/1986 | Harrington | 166/339 |
| 4,706,744 | 11/1987 | Smith et al. | 166/363 |
| 5,377,762 | 1/1995 | Turner | 166/339 |
| 5,657,823 | 8/1997 | Kogure et al. | 166/340 |
| 5,732,773 | 3/1998 | Parks et al. | 166/242.1 X |
| 5,873,415 | 2/1999 | Edwards | 166/344 |

OTHER PUBLICATIONS

Sonsub Inc. *Packoff/Spanner Assembly Drawing*, 1995, 2 pages.

*Primary Examiner*—George Suchfield

*Attorney, Agent, or Firm*—Akin, Gump, Strauss, Hauer & Feld, L.L.P.

[57] ABSTRACT

A spanner joint assembly for connecting between an upper riser and a conventional dual bore tubing hanger in a subsea well. The spanner joint assembly includes upper and lower spanner joint portions connected to each other through an emergency disconnect portion. The upper spanner joint portion has a longitudinal production bore and a longitudinal annulus. The lower spanner joint portion has a longitudinal production bore with a production bore valve and a longitudinal nonconcentric annulus access bore. The emergency disconnect portion includes an upper mandrel connected to the upper spanner joint portion and a lower mandrel connected to the lower spanner joint portion. A releasable mechanical connector includes a retaining groove in the lower mandrel and a collet connected to the upper mandrel. The collet has a latching portion extending beyond the upper mandrel which is adapted to be received in the retaining groove. An actuator sleeve extends around the collet and has a locked position and an unlocked position. The actuator sleeve maintains the collet latching portion in the retaining groove in the locked position and allows the collet latching portion to slide out of the retaining groove in the unlocked position. The production bore valve requires hydraulic pressure to hold it open and the production bore valve fails safe closed when hydraulic pressure is relieved.

14 Claims, 4 Drawing Sheets

BLOWOUT PREVENTER SPANNER JOINT WITH EMERGENCY DISCONNECT CAPABILITY

CROSS-REFERENCE TO RELATED APPLICATIONS

This application claims priority from provisional patent application Ser. No. 60/030,627 filed Nov. 8, 1996.

STATEMENT REGARDING FEDERALLY SPONSORED RESEARCH OR DEVELOPMENT

Not applicable.

BACKGROUND OF THE INVENTION

1. Field of the Invention

The present invention relates to blowout preventer spanner joints used in the oil and gas industry during subsea well completions.

2. Description of the Related Art

Blowout preventer (BOP) stack spanner joints, commonly referred to as spanners, for a concentric completion or workover well riser have been used to provide well control functions during the installation of a production tubing string in a subsea well. The spanner is included in the tool string immediately above the tubing hanger running tools. The basic functions of the spanner are as follows:

a) The spanner provides a termination for one or more external control umbilical lines and/or hoses. From the point of termination of the control umbilicals at the spanner, the control functions are contained in hydraulic and/or electrical conduits internal to the body of the spanner.

b) The spanner provides a cylindrical outer surface below the termination of the external umbilical which is positioned within the subsea BOP stack in alignment with an annular packoff element which allows closure of the packoff element thereby providing a seal to isolate the well.

c) The spanner provides a transition section between the concentric riser and the parallel bore tubing hanger. The spanner provides communication from the riser annulus to the tubing hanger annulus access bore. The transition section of the spanner includes a wireline tool diverter which allows wireline tools to be lowered through the concentric riser production bore, which is the inner bore, and to enter the annulus access bore. This transition section could also have a remotely operated lever to effect diversion of wireline tools to one bore or the other.

d) The spanner provides valves to allow isolation of the annulus access bore from the production bore and to isolate the riser annulus from the tubing hanger annulus access bore. Both valves are capable of shearing a wireline which could be in the bore when an emergency closure is required.

e) The spanner provides a valve in the production bore to isolate the tubing hanger production bore from the riser production bore. The valve is capable of shearing either a wireline or coiled tubing which could be in the bore when an emergency closure is required.

It is desirable to have a spanner joint assembly having the additional ability to separate the spanner joint assembly in the course of the testing of the well completion equipment. It is also desirable to have the ability in an emergency situation to disconnect the completion/workover riser from the completion equipment leaving the valve portions of the spanner joint assembly connected to the tubing hanger running tools.

BRIEF SUMMARY OF THE INVENTION

The present invention is a blowout preventer spanner joint with an emergency disconnect capability. The spanner joint assembly has the ability to separate the spanner joint assembly in the course of the testing of the well completion equipment. The spanner joint assembly also has the ability in an emergency situation to disconnect the completion/workover riser from the completion equipment leaving the valve portions of the spanner joint assembly connected to lower tubing hanger running tools.

The blowout preventer spanner joint assembly connects between a concentric riser or a monobore riser and a conventional dual bore tubing hanger in a subsea well. The spanner joint assembly includes upper and lower spanner joint portions connected to each other through an emergency disconnect module. The upper spanner joint portion has a longitudinal production bore and an annulus around the production bore. The lower spanner joint portion has a longitudinal production bore with a production bore valve and a longitudinal nonconcentric annulus access bore. The emergency disconnect module includes an upper mandrel connected to the upper spanner joint portion and a lower mandrel connected to the lower spanner joint portion.

A mechanical connector includes a retaining groove in the lower mandrel and a collet connected to the upper mandrel. The collet has a latching portion extending beyond the upper mandrel which is adapted to be received in the retaining groove. An actuator sleeve extends around the collet and has a locked position and an unlocked position. The actuator sleeve maintains the collet latching portion in the retaining groove in the locked position and allows the collet latching portion to slide out of the retaining groove in the unlocked position.

The production bore valve requires hydraulic pressure to hold it open and the production bore valve fails safe closed when hydraulic pressure is relieved. The longitudinal production bore of the lower spanner joint portion also includes a plug landing profile located above the production bore valve. The plug landing profile is adapted to receive a wireline set blanking plug.

BRIEF DESCRIPTION OF THE VIEWS OF THE DRAWINGS

In order to more fully understand the drawings referred to in the detailed description of the present invention, a brief description of each drawing is presented, in which.

DETAILED DESCRIPTION OF THE INVENTION

The spanner joint with emergency disconnect capability, generally referred to as the spanner joint assembly 10, will now be described in greater detail with reference to the drawings. It is to be understood that the spanner joint assembly 10 of the present invention preferably includes all of the functions of the earlier spanner joints described in the Background of the Invention and further includes an emergency disconnect module (EDM) 50 as shown in FIGS. 1A, 1B, 2 and 3.

Figure 1A:
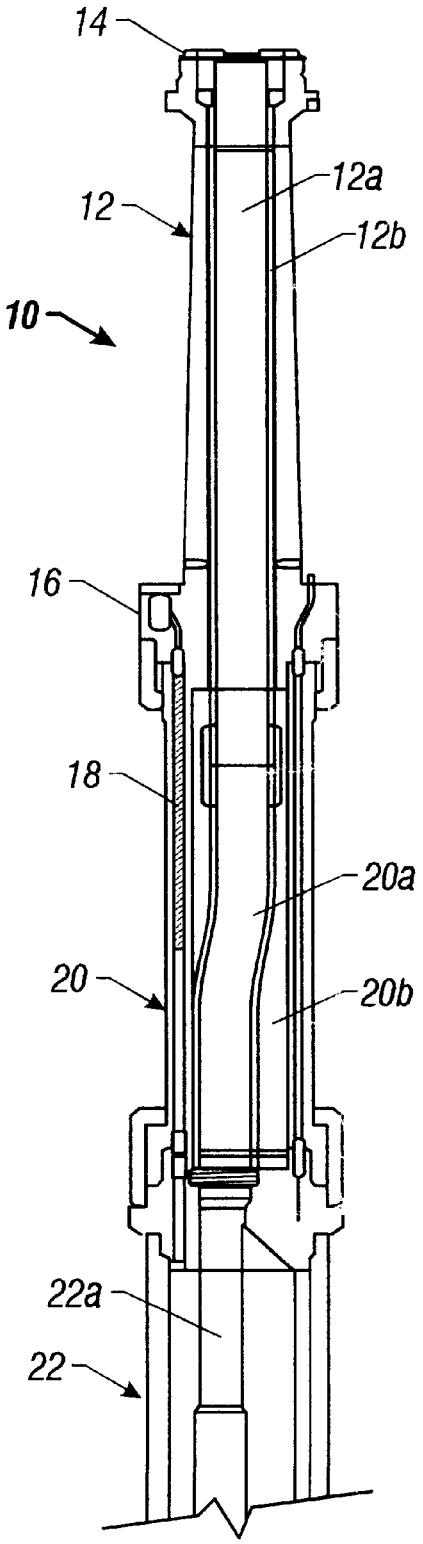
FIGS. 1A and 1B are cross-sectional elevational views of upper and lower portions, respectively, of the blowout preventer spanner joint with emergency disconnect capability according to the preferred embodiment of the present invention, the dashed lines forming an oval in FIG. 1B encircling the emergency disconnect module of the spanner joint assembly.
Figure 1B:
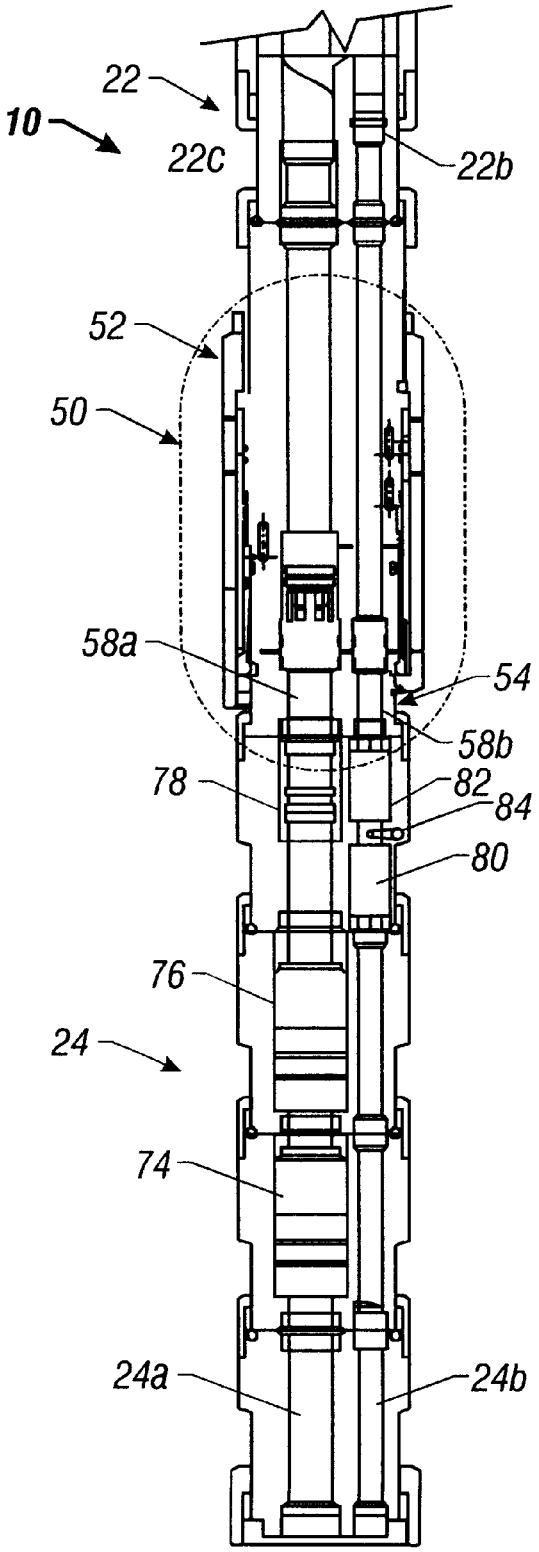

The various components of the spanner joint assembly 10 are shown in FIGS. 1A and 1B. The spanner joint assembly 10 includes an uppermost section 12 having an upper end 14 adapted to be connected to a concentric riser (not shown) or a monobore riser (not shown). It is to be understood that a concentric riser refers to an inner production pipe having a production bore mounted concentrically within an outer pipe. The annular area between the inner and outer pipe is referred to as the annulus. The production bore and the annulus provide separate conduits and well control functions during the installation of a production tubing string in a subsea well. A monobore riser, on the other hand, is a pipe having a single bore running therethrough. Such features regarding concentric and monobore risers are well known to those of ordinary skill in the art of subsea well completions. The spanner joint assembly 10 of the present invention transitions from a concentric bore at its upper end to a dual bore tubing hanger at its lower end which will be explained in more detail below. It is to be understood that when a monobore riser is used with the spanner joint assembly 10, the annulus at the upper end 14 of the uppermost section 12 is blocked and the tubing hanger annulus access bore is vented to an area outside the spanner joint assembly 10 as will be explained below.

Referring to FIG. 1A, the lower end of the uppermost section 12 includes a control connection 16. The control connection 16 is adapted to connect to the body of the spanner joint assembly 10 an external control umbilical line and/or hose (not shown) lowered from the surface. The control connection 16 is connected to hydraulic and/or electrical conduits 18 internal of the spanner joint assembly 10. It is to be understood that a plurality of control connections 16 and conduits 18 are typically included in the spanner joint assembly 10. Although not shown in the drawings for clarity purposes, it is to be understood that the conduits 18 extend down to the lower portions of the spanner joint assembly 10 for reasons which will be described below.

Still referring to FIG. 1A, a packoff section 20 is connected between the uppermost section 12 and a bore selector 22. The packoff section 20 includes a cylindrical outer surface adapted to be positioned within the subsea blowout preventer stack (not shown) and in alignment with one or more annular packoff elements of the blowout preventer stack. The termination point of the external control umbilical lines is above the packoff section 20 so as not to interfere with the annular packoff element of the blowout preventer stack.

Referring to FIGS. 1A and 1B, the bore selector 22 connects at its lower end to the EDM 50. Bore selectors 22 are well known in the art and will not be described in detail herein. The preferred bore selector 22 shown in FIGS. 1A and 1B is the subject of commonly assigned U.S. patent application Ser. No. 08/626,489, filed Aug. 3, 1996 now U.S. Pat. No. 5,732, 723, which Applicant incorporates herein by reference.

Referring to FIGS. 1A and 1B, the concentric bore in the uppermost section 12 includes the production bore 12*a* and the annulus 12*b*. The production bore is referenced as 20*a* in the packoff section 20 and the annulus is referenced as 20*b*. The production bore 20*a* in the packoff section 20 transitions from concentric to offset to provide the transition to the main bore 22*a* of the bore selector 22. The lower end of the bore selector 22 provides the option of accessing the production bore 22*c* or an annulus access bore 22*b*. The lower end of the bore selector 22 is a dual bore configuration.

Figure 3:
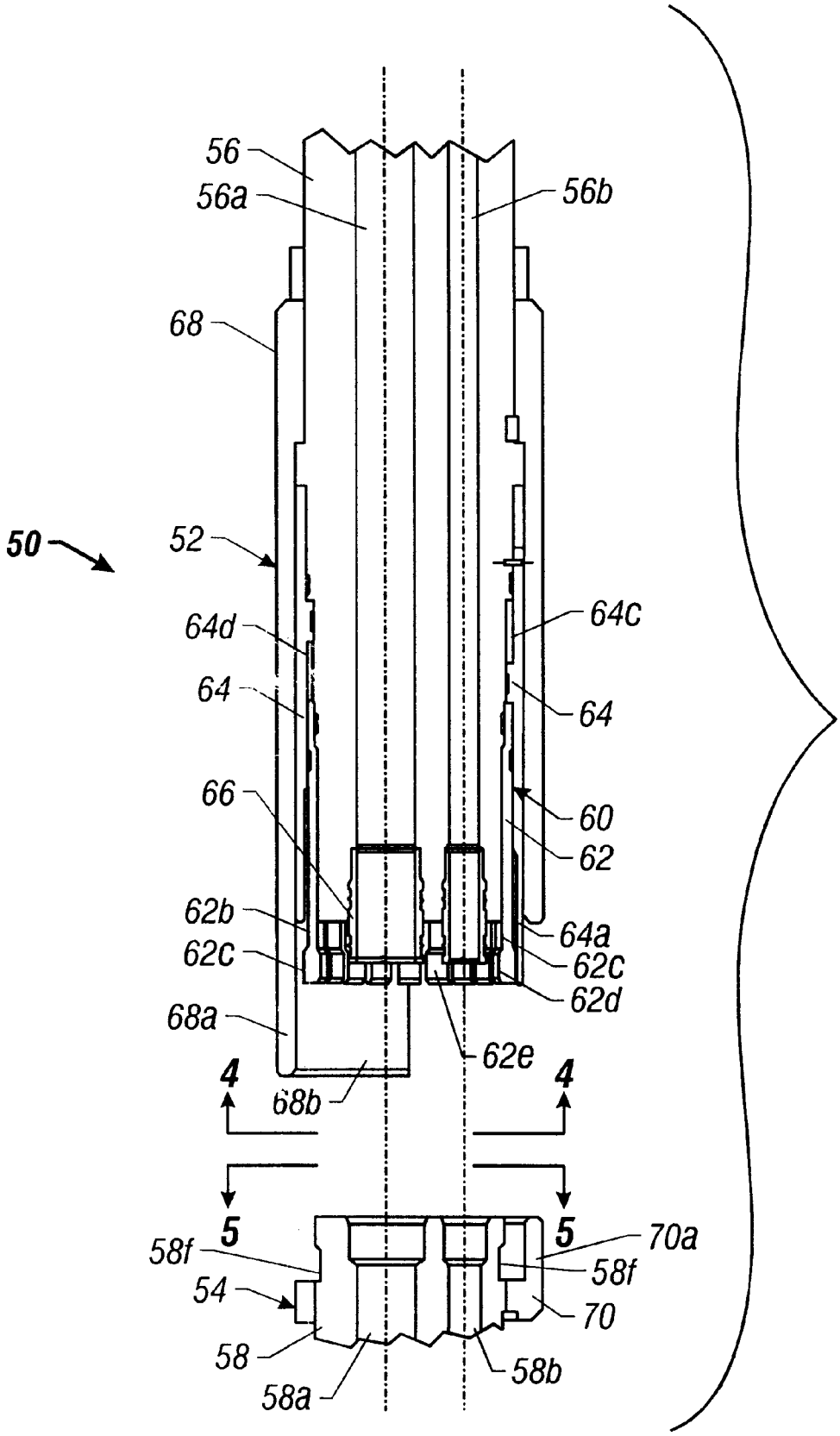
FIG. 3 is an exploded sectional view of the upper and lower portions of the emergency disconnect module of the present invention, the right hand side of the upper portion of the figure showing the mechanical connector in a locked position and the left hand side of the upper portion of the figure showing the mechanical connector in an unlocked position.
Figure 4:
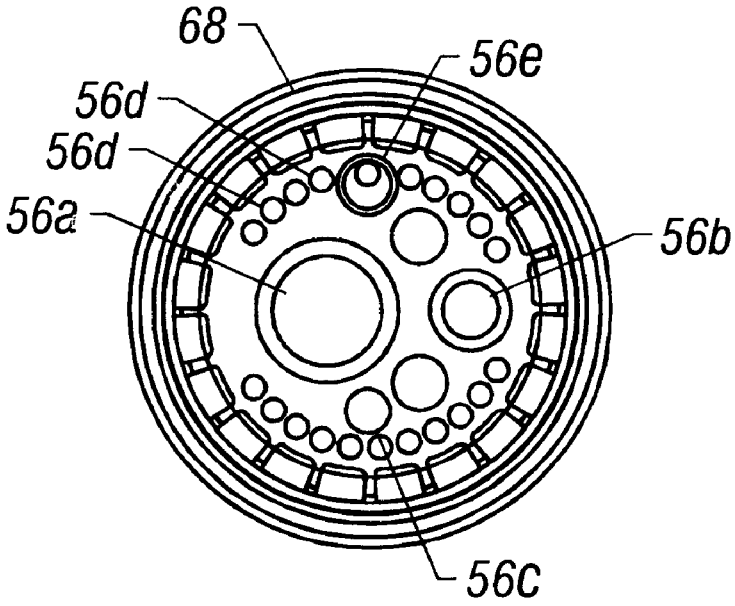
FIG. 4 is a view taken along line 4—4 of FIG. 3.

Referring to FIG. 1B, the EDM 50 is preferably located between the bore selector 22 and a valve section 24 of the spanner joint assembly 10. The EDM 50 includes an upper assembly 52 and a lower assembly 54 as shown in FIG. 3. The upper assembly 52 includes an upper mandrel 56 having a production bore 56*a* and an annulus access bore 56*b* extending therethrough. The upper mandrel 56 also includes a plurality of hydraulic conduits and electrical conduits 56*d* and 56*e*, respectively, as shown in FIG. 4. Preferably, a final alignment pin 56*c* extends from the upper mandrel 56 for reasons which will be explained below.

Figure 5:
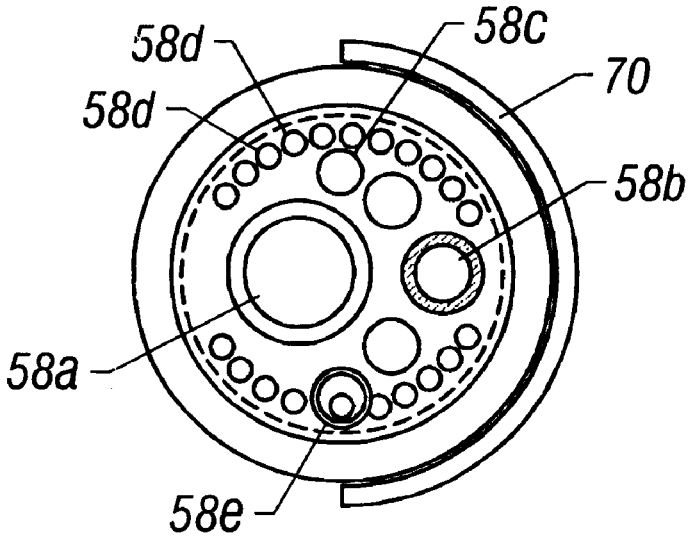
FIG. 5 is a view taken along line 5—5 of FIG. 3.

Referring to FIG. 3, the lower assembly 54 includes a lower mandrel 58 having a production bore 58*a* and an annulus access bore 58*b* extending therethrough. The lower mandrel 58 also includes a plurality of hydraulic conduits and electrical conduits 58*d* and 58*e*, respectively, as shown in FIG. 5. Preferably, a final alignment bore 58*c* is provided in the lower mandrel 58 to receive the final alignment pin 56*c*.

It is to be understood that when the upper and lower assemblies 52 and 54, respectively, are mated together that the various respective bores and conduits described above are in communication with one another by way of male stab nipples. This is well known to those of ordinary skill in the art.

The EDM 50 also includes a hydraulically actuated mechanical connector 60 to join the upper and lower assemblies 52 and 54, respectively, of the spanner joint assembly 10. The mechanical connector 60 includes a collet 62 assembled in the retrievable upper assembly 52 extending around and beyond the lower end of the upper mandrel 56. The collet 62 has a latching portion 62*e* that engages an external retaining groove 58*f* (FIG. 3) at the upper end of the lower mandrel 58 of the lower assembly 54.

Figure 2:
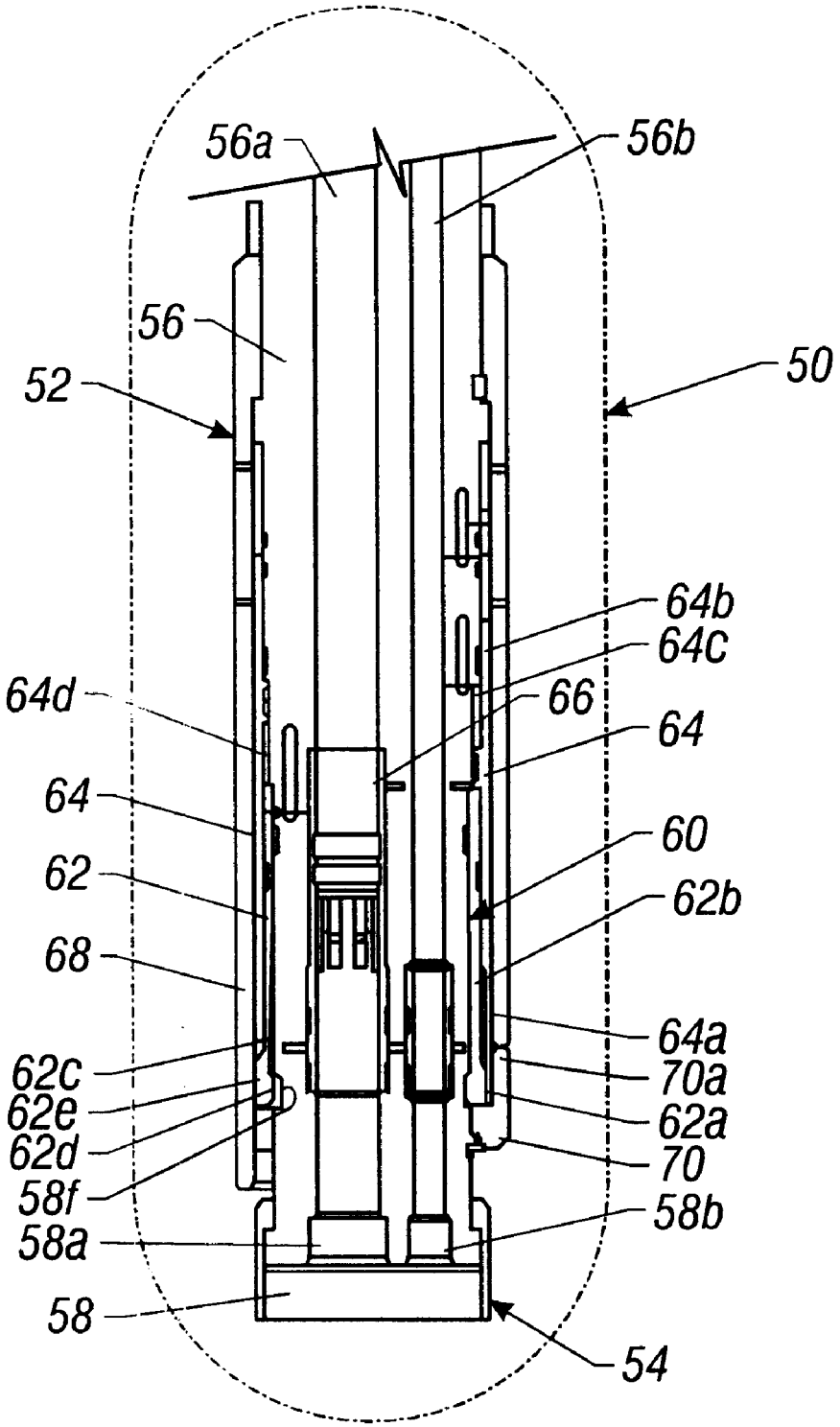
FIG. 2 is an enlarged sectional view of the emergency disconnect module shown in FIG. 1, the right hand side of the figure showing the mechanical connector in a locked position and the left hand side of the figure showing the mechanical connector in an unlocked position.

A hydraulically actuated sleeve 64 is shiftable between an upper or unlocked position and a lower or locked position. In FIGS. 1B, 2 and 3, the right hand side of each figure shows the mechanical connector 60 in the locked position and the left hand side of each figure shows the mechanical connector 60 in the unlocked position. In the lower or locked position, the actuator sleeve 64 will hold and engage the collet latching portion 62*e* with the external retaining groove 58*f* in the lower mandrel 58. In the upper or unlocked position the actuator sleeve 64 will allow the collet latching portion 62*e* to slide out of the external retaining groove 58*f*.

The hydraulic actuator sleeve 64 has at its lower end 64*a* a cylindrical section with its inner diameter chosen to pass over and trap the collet latching portion 62*e* when it is seated in the external retaining groove 58*f* as shown on the right hand side of FIG. 2.

The upper end 64*b* of the actuator sleeve 64 acts as an annular piston. When the actuator sleeve 64 is assembled in the EDM 50, the actuator sleeve 64 provides a locking chamber 64*c* and an unlocking chamber 64*d*, each of which is in communication with a hydraulic control passageway. When the locking chamber 64*c* is pressurized, the actuator sleeve 64 shifts to its lower locked position and locks the collet latching portion 62*e* in the external retaining groove 58*f*. Conversely, when the unlocking chamber 64*d* is pressurized, the actuator sleeve 64 shifts to its upper unlocked position and allows the collet latching portion 62*e* to slide in or out of the external retaining groove 58*f*.

When the upper and lower assemblies 52 and 54, respectively, of the EDM 50 are initially assembled together prior to lowering the spanner joint assembly 10 to the subsea wellhead, the actuator sleeve 64 is positioned into its locked position. Preferably, the locking and unlocking chambers 64*c* and 64*d*, respectively, have equal volumes and preferably the actuator sleeve 64 is normally hydrostatically balanced. In operation, hydraulic pressure may be maintained in the upper locking chamber 64*c* to further assure that the mechanical connector 60 is latched.

Disconnecting the upper assembly 52 from the lower assembly 54 of the EDM 50 is accomplished in the following way. Hydraulic pressure is vented from the upper locking chamber 64*c* and applied to the lower unlocking chamber 64*d* to shift the actuator sleeve 64 to the unlocked position.

A secondary way to apply hydraulic pressure to the lower unlocking chamber 64*d* is also provided for the circumstance where the hydraulic control umbilical is damaged. The secondary way to apply hydraulic pressure is provided by porting pressure to the lower unlocking chamber 64*d* from the production bore 56*a* of the upper mandrel 56 of the upper assembly 52. This is accomplished by mechanically shifting a sliding sleeve 66 in the production bore 56*a* of the upper mandrel 56. In an unshifted position, the sliding sleeve 66 seals off the production bore 56*a* from the porting to the unlocking chamber 64*d*. However, in a shifted position the sliding sleeve 66 opens hydraulic communication between the production bore 56*a* and the unlocking chamber 64*d* and the pressure from the production bore 56*a* will slide the actuator sleeve 64 to the unlocked position. Preferably, the sliding sleeve 66 can be initially shear pinned in the unshifted position and the pin will be sheared when it is desired to shift the sliding sleeve 66.

Preferably, the collet 62 is designed to minimize the required stroke length of the actuator sleeve 64 between the locked and unlocked positions. Referring to FIGS. 2 and 3, the collet 62 includes a short external upset 62*a* over the latching portion 62*e* of the collet 62 which engages the external retaining groove 58*f*. The difference between the diameters of the external upset 62*a* and the upper exterior portion 62*b* of the collet 62 is substantially the same as the difference between the diameters of the upper interior portion 62*c* of the collet 62 and the smaller internal upset 62*d* of the latching portion 62*e* which engages the external retaining groove 58*f*. The lower portion 64*a* of the actuator sleeve 64 which latches the collet latching portion 62*e* has an inner diameter slightly larger than the diameter of the external upset 62*a* of the collet 62. Releasing the collet latching portion 62*e* from the external retaining groove 58*f* thus requires only that the actuator sleeve 64 shift upward sufficiently to clear the upper end of the collet external upset 62*a*.

As discussed above, the spanner joint assembly 10 has numerous bores and electrical connections (FIGS. 4 and 5) which must be properly oriented when the EDM 50 is assembled. Orientation of the upper and lower assemblies 52 and 54, respectively, of the EDM 50 is assured by the provision of an upper orientation sleeve 68 and a lower orientation sleeve 70 as shown in FIGS. 2 and 3. The upper orientation sleeve 68 preferably extends down over the upper mandrel 56 and the actuator sleeve 64 as shown in FIG. 3. The lower end 68*a* of the upper orientation sleeve 68 includes a semicircular portion 68*b* extending below the collets 62. The semicircular portion 68*b* begins at approximately the lower end of the upper mandrel 56. The inner diameter of the upper orientation sleeve 68 is slightly larger than the outer diameter of the actuator sleeve 64. The lower orientation sleeve 70 includes a semicircular portion 70*a* extending approximately to the upper end of the lower mandrel 58. The diameter of the lower orientation sleeve 70 is the same as the diameter of the upper orientation sleeve 68.

The semicircular portion 70*a* and 68*b* must be oriented to form a circle when mating the lower assembly 54 to the upper assembly 52. The final alignment pin 56*c* and final alignment bore 58*c* provide the final alignment between the upper and lower assemblies 52 and 54, respectively. The orientation members will only engage when in the proper rotational alignment. Alternatively, the upper and lower orientation sleeves 68 and 70 could contain multiple castilations for alignment.

The valve section 24 is in the lower portion of the spanner joint assembly 10. The valve section 24 includes parallel dual bores 24*a* and 24*b* corresponding to the production bore 58*a* and the annulus bore 58*b*, respectively, of the lower assembly 54. Preferably, the production bore 24*a* includes a first production bore valve 74 which may be a shearing-type of production bore valve. Preferably, a second production bore valve 76 is included above the first production bore valve 74 as shown in FIG. 1B. The second production bore valve 76 provides redundancy and is preferably a fail-safe closed design requiring a single hydraulic control line to hold the valve 76 in the open position. When the hydraulic control line is vented, a spring mechanism (not shown) in the valve 76 shifts the valve to the closed position.

A plug landing profile 78 is provided in the production bore 24*a* to receive a wireline set blanking plug (not shown) in the production bore 24*a*. The plug landing profile 78 is located above both production bore valves 74 and 76 so that access is not obstructed in the event of a valve failing in a partially closed position.

The features of the second production bore valve 76 and the plug landing profile 78 enhance the well safety in the event of a subsea separation of the spanner joint assembly 10.

The annulus access bore 24*b* includes a tubing hanger isolation valve 80 and an annulus isolation valve 82 as shown in FIG. 1B. Both valves 80 and 82 are capable of shearing a wireline which could be in the annulus access bore 24*b* when an emergency closure is required.

Referring to FIG. 1B, an annulus bypass port 84 is preferably positioned between the tubing hanger isolation valve 80 and the annulus isolation valve 82. The annulus bypass port 84 is in fluid communication with the annulus access bore 24*b*. In the preferred embodiment of the spanner joint assembly 10 when used with a concentric riser, the annulus bypass port 84 extends up through the valve section 24, EDM 50, and the bore selector 22. It is to be understood that the annulus bypass ports 84 is in fluid communication with the annulus 20*b* in the packoff section 20 which is in fluid communication with the annulus 12*b* in the uppermost section 12. When a monobore riser is used with the spanner joint assembly 10, the annulus 12*b* at the upper end 14 is blocked off so that the bore of the monobore riser is in fluid communication with the production bore 12*a* and not with the annulus 12*b*. In the case of the monobore riser, the annulus bypass port 84 vents the annulus access bore 24*b* of the valve section 24 through the wall of the body of the valve section 24.

The foregoing disclosure and description of the invention is illustrative and explanatory thereof, and various changes in the size, shape, and materials, as well as in the details of illustrative construction and assembly, may be made without departing from the spirit of the invention.

We claim:

1. A spanner joint assembly for connecting between an upper riser and a conventional dual bore tubing hanger in a subsea well, the spanner joint assembly comprising:

an upper spanner joint portion having a longitudinal production bore and a longitudinal concentric annulus;

an emergency disconnect portion including an upper disconnect assembly and a lower disconnect assembly, said upper disconnect assembly connected to said upper spanner joint portion;

a lower spanner joint portion having a longitudinal production bore and a longitudinal nonconcentric annulus access bore, said lower spanner joint portion connected to said lower disconnect assembly;

a plurality of valves in said lower spanner joint portion; and a mechanical connector locking said upper disconnect assembly to said lower disconnect assembly.

2. The spanner joint assembly of claim 1, wherein said upper spanner joint portion includes a packoff section having a cylindrical outer surface adapted to be positioned within a blowout preventer and in alignment with an annular packoff element of the blowout preventer.

3. The spanner joint assembly of claim 2, wherein said upper spanner joint portion includes a control connection adapted to connect to an external control line, said control connection located above said packoff section and said packoff section including an internal conduit in communication with said control connection.

4. The spanner joint assembly of claim 2, wherein said upper spanner joint portion includes a bore selector.

5. The spanner joint assembly of claim 1, wherein said plurality of valves includes a production bore valve requiring hydraulic pressure to hold said production bore valve open, said production bore valve fails safe closed when hydraulic pressure is relieved.

6. The spanner joint assembly of claim 5, wherein said longitudinal production bore of said lower spanner joint portion includes a plug landing profile located above said production bore valve, said plug landing profile adapted to receive a wireline set blanking plug.

7. The spanner joint assembly of claim 1, wherein said lower disconnect assembly includes a lower mandrel and said upper disconnect assembly includes an upper mandrel, said mechanical connector comprises:

a retaining groove in said lower mandrel;

a collet connected to said upper mandrel, said collet having a latching portion extending beyond said upper mandrel, said collet latching portion adapted to be received in said retaining groove;

an actuator sleeve extending around said collet, said actuator sleeve having a locked position and an unlocked position, said actuator sleeve maintains said collet latching portion in said retaining groove in said locked position and said actuator sleeve allows said collet latching portion to slide out of said retaining groove in said unlocked position.

8. The spanner joint assembly of claim 7, wherein said actuator sleeve extends around said upper mandrel, said actuator sleeve and said upper mandrel providing a locking chamber and an unlocking chamber, each of said locking and unlocking chambers in communication with a hydraulic control passageway, wherein pressurizing said locking chamber shifts said actuator sleeve to said locked position and pressurizing said unlocking chamber shifts said actuator to said unlocked position.

9. A spanner joint assembly for connecting between an upper riser and a conventional dual bore tubing hanger in a subsea well, the spanner joint assembly comprising:

an upper spanner joint portion having a production bore and an annulus;

an emergency disconnect portion including an upper mandrel and a lower mandrel, said upper mandrel connected to said upper spanner joint portion;

a lower spanner joint portion having a production bore and a nonconcentric annulus access bore, said lower spanner joint portion connected to said lower mandrel;

a production bore valve in said lower spanner joint portion; and a releasable mechanical connector comprising:

a retaining groove in said lower mandrel;

a collet connected to said upper mandrel, said collet having a latching portion extending beyond said upper mandrel, said collet latching portion adapted to be received in said retaining groove;

an actuator sleeve extending around said collet, said actuator sleeve having a locked position and an unlocked position, said actuator sleeve maintains said collet latching portion in said retaining groove in said locked position and said actuator sleeve allows said collet latching portion to slide out of said retaining groove in said unlocked position.

10. The spanner joint assembly of claim 9, wherein said upper spanner joint portion includes a packoff section having a cylindrical outer surface adapted to be positioned within a blowout preventer and in alignment with an annular packoff element of the blowout preventer.

11. The spanner joint assembly of claim 10, wherein said upper spanner joint portion includes a control connection adapted to connect to an external control line, said control connection located above said packoff section and said packoff section including an internal conduit in communication with said control connection.

12. The spanner joint assembly of claim 10, wherein said upper spanner joint portion includes a bore selector.

13. The spanner joint assembly of claim 9, wherein said production bore valve requires hydraulic pressure to hold said production bore valve open and said production bore valve fails safe closed when hydraulic pressure is relieved.

14. The spanner joint assembly of claim 13, wherein said production bore of said lower spanner joint portion includes a plug landing profile located above said production bore valve, said plug landing profile adapted to receive a wireline set blanking plug.

* * * * *